US005348282A

United States Patent [19]

Choi et al.

[11] Patent Number: 5,348,282

[45] Date of Patent: Sep. 20, 1994

[54] SELF ADJUSTING FEED ROLL

[75] Inventors: Injae Choi; Joseph J. Ferrara, both of Webster, N.Y.

[73] Assignee: Xerox Corporation, Stamford, Conn.

[21] Appl. No.: 131,249

[22] Filed: Oct. 4, 1993

[51] Int. Cl.[5] ..... B65H 3/06

[52] U.S. Cl. ..... 271/117; 271/109; 271/121

[58] Field of Search ..... 271/109, 116, 117, 121, 271/122, 274

[56] References Cited

U.S. PATENT DOCUMENTS

| | | | |
|---|---|---|---|
| 3,866,903 | 2/1975 | Eppe et al. | 271/119 |
| 4,157,825 | 6/1979 | Ellenberger et al. | 271/10 |
| 4,316,606 | 2/1982 | Buys et al. | 271/122 |
| 4,682,768 | 7/1987 | Iida et al. | 271/122 |
| 4,928,948 | 5/1990 | Evangelista et al. | 271/110 |
| 5,149,077 | 9/1992 | Martin et al. | 271/18.3 |

FOREIGN PATENT DOCUMENTS

| | | | |
|---|---|---|---|
| 0258339 | 10/1988 | Japan | 271/274 |
| 0258340 | 10/1988 | Japan | 271/274 |
| 9112193 | 8/1991 | World Int. Prop. O. | 271/121 |

*Primary Examiner*—H. Grant Skaggs

[57] ABSTRACT

An automatically self-adjusting nudger roll for use in a friction retard feeder includes two rolls held together by a spring with one of the rolls being fixedly attached in a position while the other acts as a rotating feed roll. The other roll is mounted to orbit around the outer surface of the fixedly positioned roll. This assembly automatically adjusts the normal force on substrates as the requirement of the feed force changes and thereby reduces misfeeds and multifeeds.

17 Claims, 2 Drawing Sheets

SELF ADJUSTING FEED ROLL

BACKGROUND OF THE INVENTION

This invention is directed generally to friction retard feeders, and more particularly, to an improved nudger for use is such feeders.

Traditionally, nudger rolls are employed in friction retard feeders to move the top substrate(s) from a stack to a retard mechanism as a result of a net frictional force. The retard mechanism allows a single substrate at a time to pass through the mechanism. Some nudger rolls are constructed from an elastomeric material. These rolls have a failure mode of loss of a suitably high friction coefficient due to contamination, dirt build-up and wear. Other nudger rolls are in the form of a series of metal pin wheels which act to grab or stick the top sheet in the stack and move it into the friction retard mechanism. A studded roll of this type works well for most substrate types, and has a long roll life. However, the studded roll does not handle high density substrates very well due to an ability to penetrate the substrate surface. Also, the studded roll does not handle transparencies satisfactorily. Further, the studded roll may leave scratch marks on the surface of substrates fed at high feed rates.

When a rotating roll is used to feed the paper by the frictional force between them, the maximum available feed force is determined by the product of the normal force and the coefficient of friction between the roll and the substrate which could be paper, transparencies, etc. Because the coefficient of friction is uncertain in nature, the maximum available feed force is mainly controlled by the normal force. That is, as the required feed force increases, the normal force is also set to a larger value. In most machines that use nudger rolls as feed rolls, the normal force is set to a fixed optimum value to meet the particular design requirements. But there may still appear a failure, such as misfeed, as the design environment changes. Attempts at overcoming these nudger roll deficiencies include U.S. Pat. No. 3,866,903 which discloses a sheet feeding apparatus that delivers a top sheet of a stack to advancing rolls by using a cylindrical sleeve comprised of an elastomeric material with a high coefficient of friction. The sleeve is rotated by a drive to move the top sheet towards the advancing rolls. A device for separating single textile workpieces from the top of a stack is shown in U.S. Pat. No. 4,157,825 that includes a holding member having holding pins and a rotatable member having a plurality of radially extending bristles. The holding member causes an engagement of the topmost workpiece with the pins. The rotatable member directs the topmost workpiece. A pair of nudger rolls are disclosed in U.S. Pat. No. 4,928,948 for urging a sheet toward feed rolls that are on the same centerline in the feed direction. A hybrid nudger roll is disclosed in U.S. Pat. No. 5,149,077 for use in a friction retard feeder that includes alternating elastomeric and studded rolls positioned on a support shaft. The outer surface of the elastomeric rolls extends beyond the tips of the studded rolls, but when the elastomeric rolls are deformed against a stack of sheets due to normal force, the tips of the studded rolls extends beyond the outer surface of the elastomeric rolls. Even with availability of the abovementioned nudger rolls, the need still exists for a nudger roll useful in retard feeders for shingling a wide variety of substrates which can adjust the normal force as the requirements for the feed force changes.

Accordingly, in an aspect of this invention, a self-adjusting nudger roll is disclosed which comprises two rolls held together by a spring with one of the rolls being fixedly attached in a position while the other acts as a rotating feed roll and simultaneously orbit about the surface of the one roll. The assembly automatically adjusts the normal force on substrates as the requirement of the feed force changes and thereby reduces misfeeds and multifeeds.

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
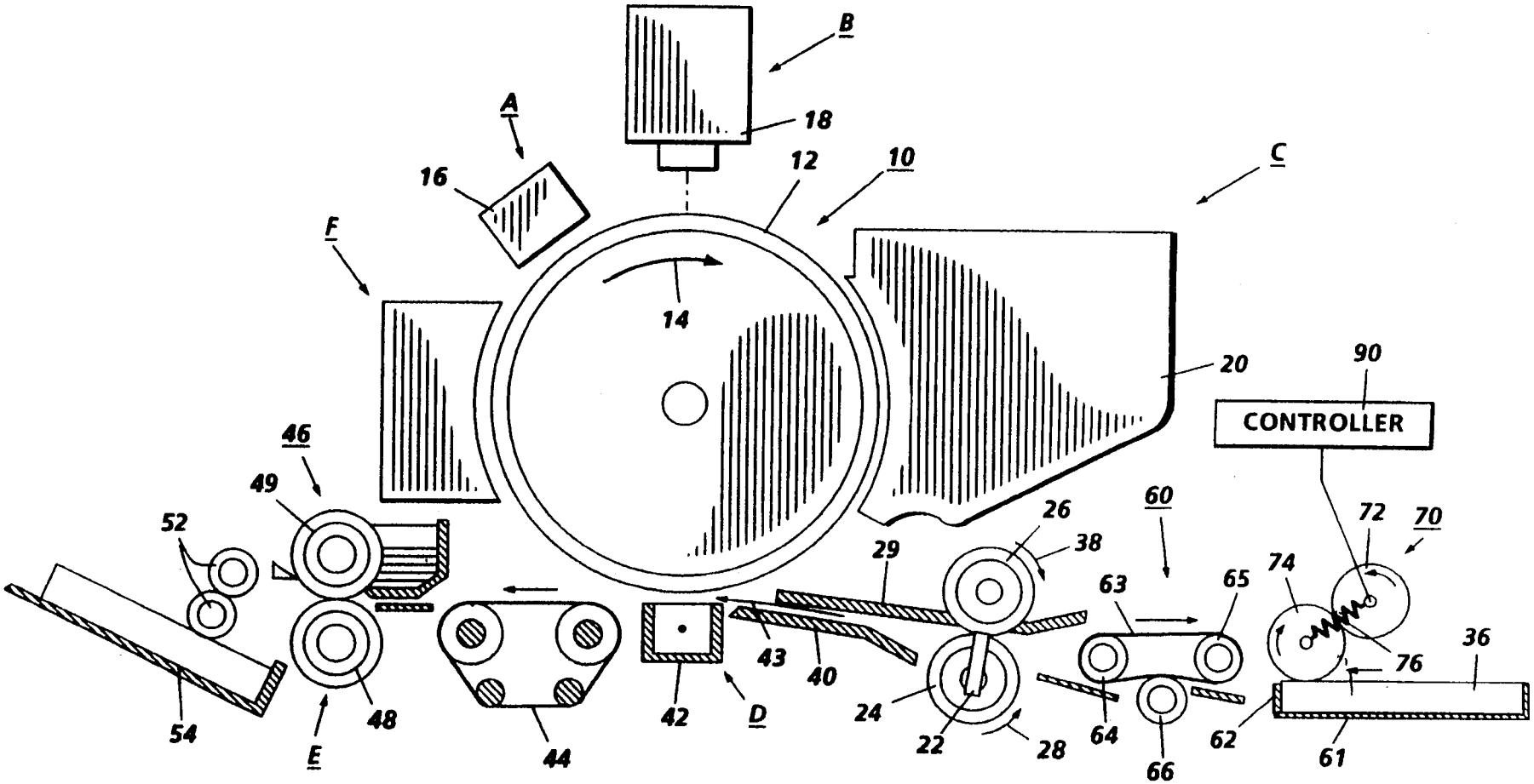
FIG. 1 is a schematic elevational view of an electrophotographic printing machine incorporating the features of one aspect of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in this application to the particular embodiment shown herein. For example, the apparatus of the present invention will be described hereinafter with reference to feeding successive substrates, such as, copy sheets, however, one skilled in the art, will appreciate that it may also be employed for feeding successive original documents.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a conventional corona generating device, indicated generally by the reference numeral 16, to charge photoconductive surface 12 to a relatively high substantially uniform potential.

Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is acheived by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document. Obviously, electronic imaging of page image information could be used, if desired.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent imagerecorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by retard sheet feeding apparatus 60 to transfer station D. Nudger roll 70 of sheet feeding apparatus 60 advances one or more copy sheets to a retard nip formed at the unsupported section of belt 63 which is supported for rotation by drive roll 64 and idler roll 65 and retard roll 66. Retard roll 66 applies a retarding force to shear any multiple sheets from the sheet being fed and forwards it to registration roller 24 and idler roller 26. Registration roller 24 is driven by a motor (not shown) in the direction of arrow 28 and idler roller 26 rotates in the direction of arrow 38 since roller 24 is in contact therewith. In operation, feed device 60 operates to advance the uppermost sheet from stack 36 into registration rollers 24 and 26 and against registration fingers 22. Fingers 22 are actuated by conventional means in timed relation to an image on drum 12 such that the sheet resting against the fingers is forwarded toward the drum in synchronism with the image of the drum. The sheet is advanced in the direction of arrow 43 through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the top feeder system in greater detail.

Figure 2:
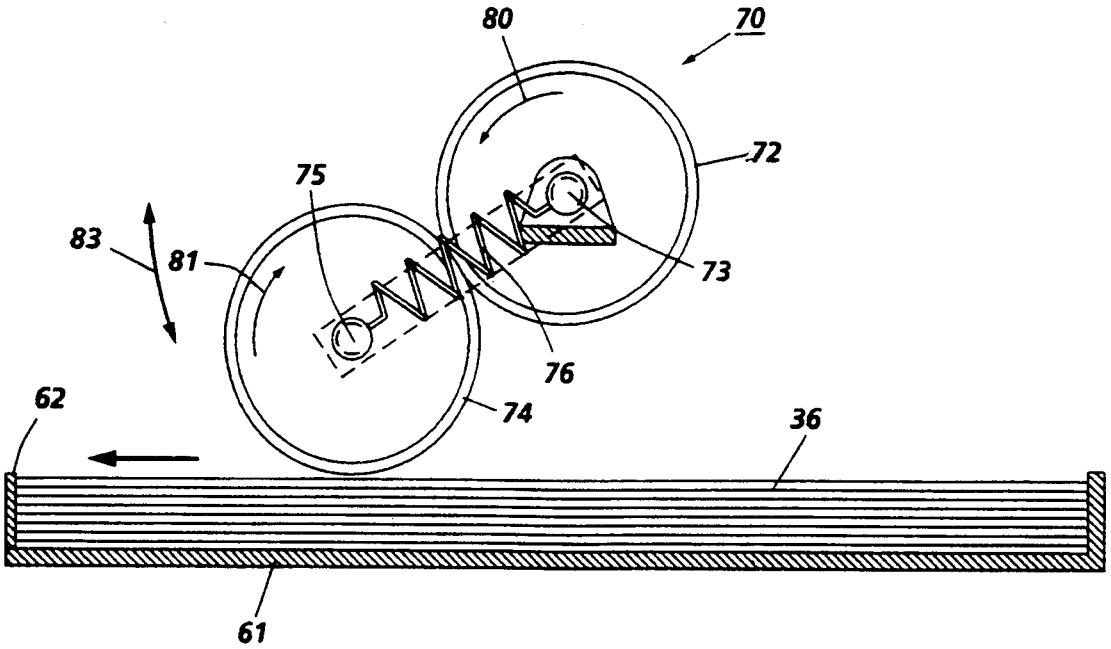
FIG. 2 is an enlarged partial side view of the automatically self-adjusting nudger roll shown in FIG. 1.
Figure 3:
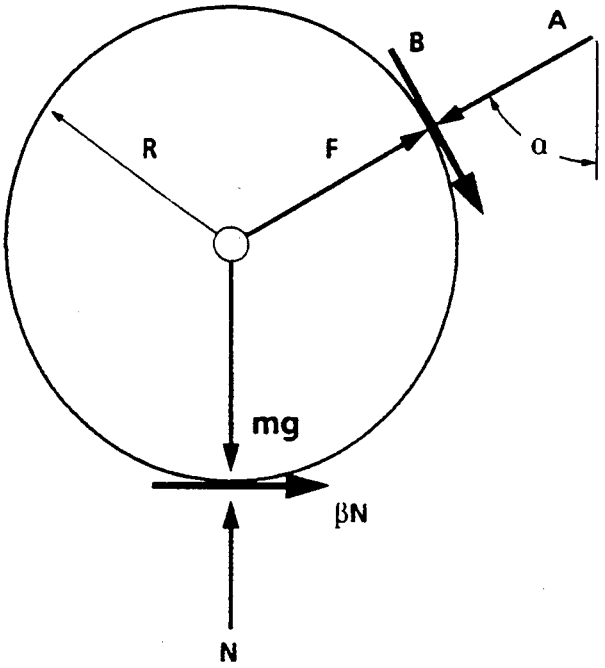
FIG. 3 is a free body diagram of the automatically self-adjusting nudger roll employed in the feeder of FIG. 1.

Referring now to FIGS. 2 and 3, the detailed structure and operation of the nudger roll will be described where retard feeder 60 includes an automatically self-adjusting nudger roll 70 positioned above sheets 36 stacked on platform 61 that has a sheet retaining wall 62 attached thereto. Nudger roll 70 comprises a feed roll 72 in FIG. 2 which is controlled by controller 90 and mounted on shaft 73 that is connected to a one-way clutch (not shown) with the shaft 73 being adapted for rotation in the direction of arrow 80 by a suitable motor (not shown). Feed roll 72 is in driving contact with idler feed roll 74 which is mounted on shaft 75 for rotation in the direction of arrow 81. The two feed rolls are contactedly connected to each other by a spring 76 that is attached to shafts 73 and 75. The spring maintains the contact between the feed rolls and shaft 73 of feed roll 72 is fixed in position while shaft 75 of feed roll 74 is movably mounted so as to be freely rotated and orbited in the direction of arrow 83 around feed roll 72 in order to automatically adjust the normal force of feed roll 74 against copy sheets in the tray as the requirement for the feed force changes, i.e., different copy sheet weights or transparencies, etc., are to be fed. This system improves over current nudger roll feeders by varying the normal force based on the actual sheet feed needs.

FIG. 3 shows a schematic diagram for the static equilibrium of the nudger feed roll system. In FIG. 3, F denotes the spring force, A the normal contact force between feed rolls 72 and 74 and B the tangential force. The direction of the force A is given by the angle a. The weight of feed roll 74 is represented by mg. The normal force between feed roll 74 and the copy sheets 36 is denoted by N while the tangential force caused by the copy sheets is denoted by $\beta N$. As the required feed force increases, the parameter $\beta$ will increase until it reaches the maximum value of the coefficient of friction. From the equilibrium conditions, one has:

$$A = F + \beta mg(1 + \cos\alpha)/\{\sin\alpha - \beta(1 + \cos\alpha)\}$$

$$N = mg\sin\alpha/\{\sin\alpha - \beta(1 + \cos\alpha)\}$$

$$B = \beta N$$

Now for example, if a is equal to 90°, the normal force is given by $N=mg/(1-\beta)$. If the coefficient of friction is 0.9, it is seen that the maximum N is equal to 10 mg and the maximum available feed force is 9 mg, while the normal force is mg if there is no resistance from the substrate ($\beta=0$). Most of the friction feeder technology currently being utilized has a fixed normal force. The automatic self-adjusting nudger feeder system 70 improves over systems of the past by varying the normal force based on the actual need for feeding a particular substrate or set of substrates. Therefore, this system improves on the misfeeding problem of past systems. In addition, the system 70 improves over systems in the past for preventing multifeeding since the normal force exerted on the substrate is usually lower than that of previous nudger roll systems. The operating window in previous nudger roll systems is narrow because of the competition between the multifeed parameters and the misfeed parameters. With the automatic self-adjusting nudger feeder system 70 the operating window will be much greater because the normal force is automatically set to the optimum value. The automatic self-adjusting nudger feeder system 70 can also be extended for use as a cross roll side registration environment because the normal force will decrease if the substrate is stalled when a is equal to, for example, 270°.

While the present automatically self-adjusting feeding system has been described in the environment of a friction retard feed roll apparatus, it should be understood that the self-adjusting feed roll system of the present invention can be used as the sole substrate feeding mechanism in a corner buckle feed apparatus as well.

In conclusion, an automatically self-adjusting nudger roll for a friction retard feeder is disclosed which varies normal force according to needs for feeding a particular type of substrate. As configured, the nudger roll comprises two rolls held together by a spring with a drive roll being supported by a fixedly positioned shaft and an idler nudger roll being movably mounted on a shaft in order to rotate about the outer surface of the drive roll, thereby enhancing the feeding of light and heavy weight sheets, as well as, transparencies.

It is, therefore, evident that there has been provided in accordance with the present invention a nudger roll for use in a friction retard feeder which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An automatically self-adjusting nudger roll system for use in a friction retard feeder for feeding substrates from a stack to a retard mechanism, comprising:

a drive roll mounted on a rotatable, fixed first shaft;

an idler roll mounted on a rotatable, movable second shaft;

a spring attached to both of said first and second shafts for contactedly connecting outer surfaces of said drive roll and said idler roll, said second shaft being adapted for movement with respect to said first shaft in order to move the outer surface of said idler around the outer surface of said drive roll such that the normal force of said idler roll against the stack is automatically adjusted to an optimum value according to the characteristics of substrates being fed.

2. The nudger roll system of claim 1, wherein said spring is a tension spring.

3. A self-adjusting nudger roll device for use in a friction retard feeder for feeding substrates from a stack to a retard mechanism, comprising:

first and second feed rolls with contacting outer surfaces, said first feed roll being fixed against orbital movement while said second feed roll is adapted for orbital movement about said first feed roll; and means for applying a force to said second feed roll to press it against said first feed roll and the substrate stack in order to provide sufficient normal force of said second feed roll against the substrate stack and automatically adjust the normal force to an optimum value according to the characteristics of substrates being fed by orbiting said second feed roll about the surface of said first feed roll.

4. The nudger roll device of claim 3, wherein said means for applying a normal force to said second feed roll is a tension spring.

5. The nudger roll device of claim 4, wherein said first feed roll is a drive roll and said second feed roll is an idler feed roll.

6. The nudger roll device of claim 5, wherein said drive and idler feed rolls are mounted on rotatable shafts and said tension spring is connected to said shafts.

7. The nudger roll device of claim 6, wherein said drive feed roll is actuated by a controller.

8. The nudger roll device of claim 3, wherein said first and second feed roll are rotated in opposite directions.

9. The nudger roll device of claim 8, wherein said second feed roll is rotated in the direction of substrate feeding.

10. In a reproduction system adapted to make copies of page image information by transferring the page image information to copy sheets fed from a copy sheet feeder, the improvement in the copy sheet feeder characterized by:

first and second feed rolls with contacting outer surfaces, said second feed roll being adapted for orbital movement about said first feed roll and means for applying a normal force to said second feed roll to press it against substrates in a stack in order to provide sufficient normal force of said second feed roll against the substrate stack and automatically adjust the normal force to an optimum value according to the characteristics of substrates in the stack.

11. The reproduction system of claim 10, wherein said means for applying a normal force to said second feed roll is a tension spring.

12. The reproduction system of claim 11, wherein said first feed roll is a drive roll and said second feed roll is an idler feed roll.

13. The nudger roll device of claim 12, wherein said drive and idler feed rolls are mounted on rotatable shafts and said tension spring is connected to said shafts.

14. The reproduction system of claim 13, wherein said drive feed roll is actuated by a controller.

15. The reproduction system of claim 10, wherein said first and second feed roll are rotated in opposite directions.

16. The reproduction system of claim 15, wherein said second feed roll is rotated in the direction of substrate feeding.

17. An automatically self-adjusting feed roll system for feeding substrates from a stack, comprising:

a drive roll mounted on a rotatable, fixed first shaft;

a feed roll mounted on a rotatable, movable second shaft;

a spring attached to both of said first and second shafts for contactedly connecting outer surfaces of said drive roll and said feed roll, said second shaft being adapted for orbital movement with respect to said first shaft in order to move the outer surface of said feed around the outer surface of said drive roll such that the normal force of said feed roll against the stack is automatically adjusted to an optimum value according to the characteristics of substrates being fed.

* * * * *